US006779817B2

(12) United States Patent
Ota

(10) Patent No.: US 6,779,817 B2
(45) Date of Patent: Aug. 24, 2004

(54) TOOL FOR MAKING DECORATIVE KNOT

(75) Inventor: Hiroko Ota, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/405,447

(22) Filed: Apr. 2, 2003

(65) Prior Publication Data

US 2003/0193196 A1 Oct. 16, 2003

(30) Foreign Application Priority Data

Apr. 12, 2002 (JP) ..... 2002-110692

(51) Int. Cl.[7] ..... D03J 3/00
(52) U.S. Cl. ..... 289/17; 289/18.1
(58) Field of Search ..... 289/1.2, 1.5, 2, 289/17, 18.1

(56) References Cited

U.S. PATENT DOCUMENTS 1,853,790 A * 4/1932 Westcott ..... 434/260
2,624,957 A * 1/1953 Collins ..... 434/260
4,017,984 A * 4/1977 Bonfigli ..... 434/260
6,015,172 A * 1/2000 Williams et al. ..... 289/2

* cited by examiner

*Primary Examiner*—Gary L. Welch
(74) *Attorney, Agent, or Firm*—Merchant & Gould P.C.

(57) ABSTRACT

A tool is provided for facilitating the making of a decorative knot. The knot-making tool includes a generally flat main body, and several string engagement cutouts formed on the periphery of the main body. The string is brought into engagement with these cutouts in the prescribed order specified by the indication marks put on the main body.

8 Claims, 16 Drawing Sheets

TOOL FOR MAKING DECORATIVE KNOT

BACKGROUND OF THE INVENTION

1. Field of the Invention

The present invention relates to a tool for making a decorative knot which is formed by tying a string and used for decorating clothing, small personal belongings, house interiors or the like.

2. Description of the Related Art

Decorative knots have a long history and various kinds of knots are still in use. Even today, such decorative knots are usually formed by the traditional method, i.e. by using both hands to hold a string and tie knots in accordance with the predetermined steps. For example, an "igeta-musubi" (knot of a parallel cross pattern), as shown in FIG. 12, is formed by tying a string S in accordance with prescribed steps.

However, the conventional knot making is difficult to perform and tends to require much time. Though people who are unaccustomed to it may refer to commercially available manuals illustrating how to make knots, they often find it difficult to make a proper knot even with the aid of such a reference book. This is because decorative knots are often too complicated to permit ordinary people to readily understand the procedures illustrated in the reference book.

Further, even if the desired decorative knot has been formed after a struggle, the subsequent shape adjustment of the obtained knot can also be difficult to accomplish for unaccustomed people. According to the conventional manner, making identical decorative knots, standardized in size, shape, etc., is also difficult.

For some kinds of decorative knots, use can be made of an auxiliary tool, such as a pin stand consisting of a base and a plurality of pins put up on the base for hooking a string in making the desired knot. With the use of the pin stand, the knot-making work may be performed more easily. However, in using the pin stand, the user sometimes finds it difficult to pass the string around the pins properly because of the intrinsic complexity of the decorative knot. In addition, the conventional pin stand has a simple structure, with a plurality of pins being put up on the base for simply hooking a string. Accordingly, relatively complex decorative knots cannot be formed.

SUMMARY OF THE INVENTION

The present invention has been proposed under the circumstances described above. It is, therefore, an object of the present invention to provide a novel knot-making tool by which a decorative knot, even if fairly complex in structure, can be easily made by people who are unaccustomed to the knot-making.

According to the present invention, there is provided a tool for making a decorative knot. The tool comprises: a generally flat main body, and a plurality of string engagement portions provided in relation to the main body. The string engagement portions come into engagement with a string in a prescribed order.

Preferably, the string engagement portions may comprise a cutout formed on a periphery of the main body.

Preferably, the tool of the present invention may further comprise indications arranged correspondingly to the string engagement portions for showing the engaging order of the string.

Preferably, the above-mentioned indications comprise a plurality of patterns by which representing manners of figures are different from each other. Each of the patterns indicates the way to operate the string in relation to the main body.

Preferably, the main body is flexible, so that the engaging parts of the string are easily disengaged from the main body.

Preferably, the main body is formed with at least one through-hole for allowing the string to pass from one side of the main body to the other side.

Preferably, the tool of the present invention may further comprise a hook provided on the main body for engaging with a loop of the string. This hook temporarily holds the string in making the desired decorative knot.

Preferably, the main body may be formed with at least one groove for facilitating the passage of the string.

Preferably, the main body may be formed with at least two projections flanking the groove.

Other features and advantages of the present invention will become clearer from the detailed description given below with reference to the accompanying drawings.

BRIEF DESCRIPTION OF THE DRAWINGS

FIG. 2A is a front view illustrating the knot maker of the first embodiment, whereas

FIG. 5A is a front view illustrating the knot maker of the second embodiment, whereas

FIG. 8A is a front view illustrating the knot maker of the third embodiment, whereas

FIG. 10B is a front view illustrating the knot maker of the fourth embodiment, whereas

DETAILED DESCRIPTION OF THE PREFERRED EMBODIMENTS

Preferred embodiments of the present invention will be described below in detail with reference to the accompanying drawings.

Figure 1:
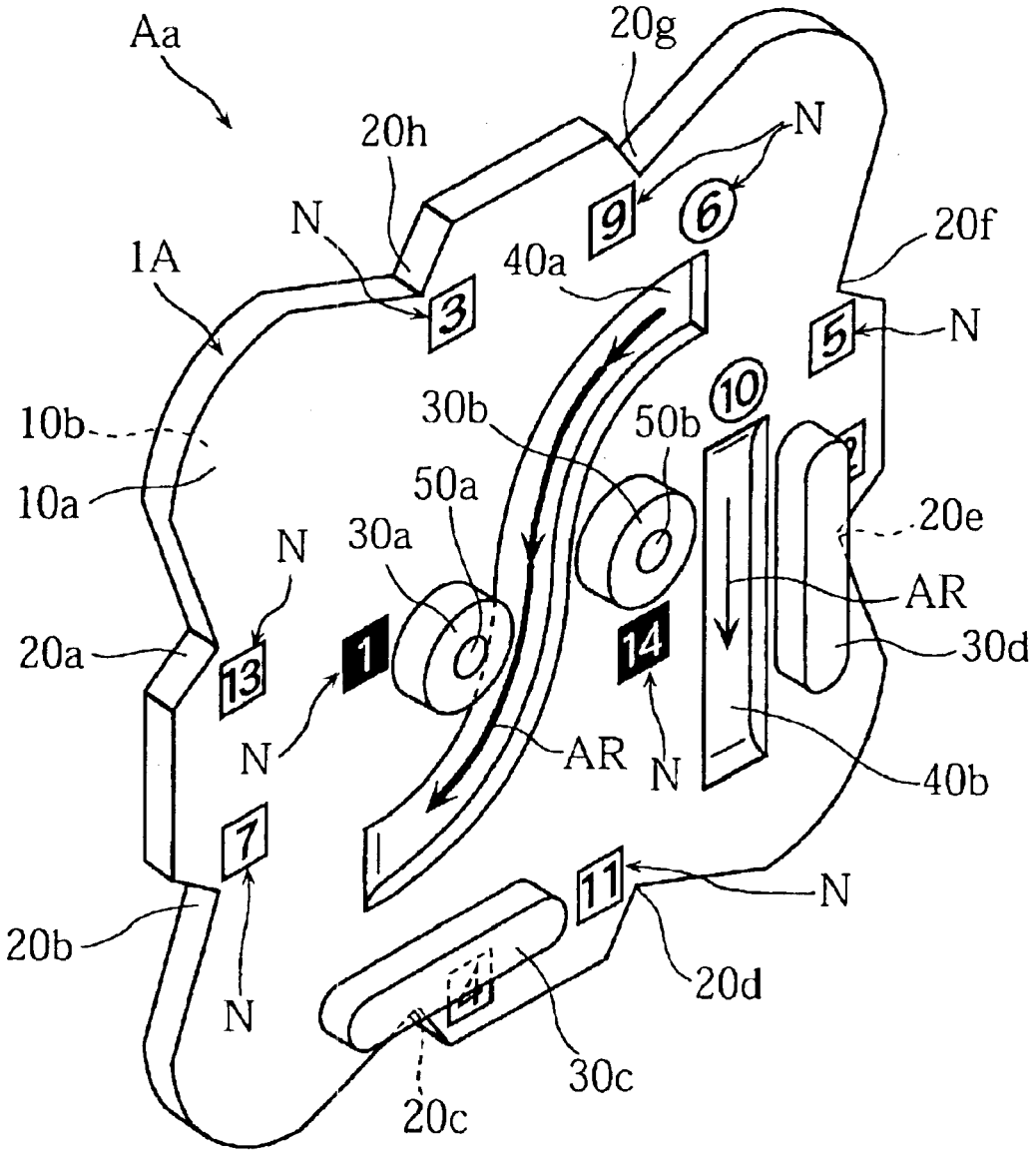
FIG. 1 is a perspective view illustrating a decorative knot maker according to a first embodiment of the present invention.
Figure 2A:
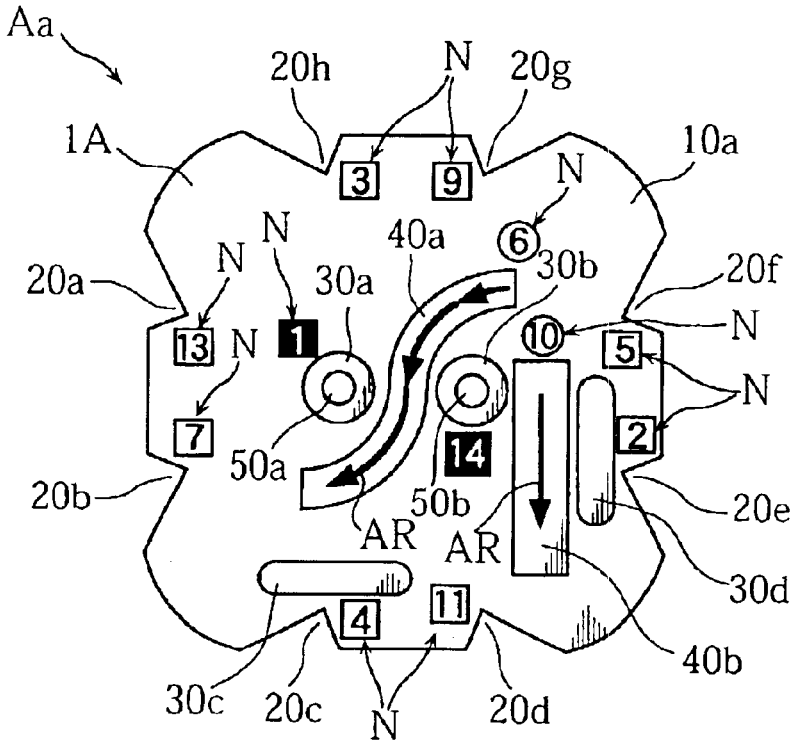
Figure 2B:
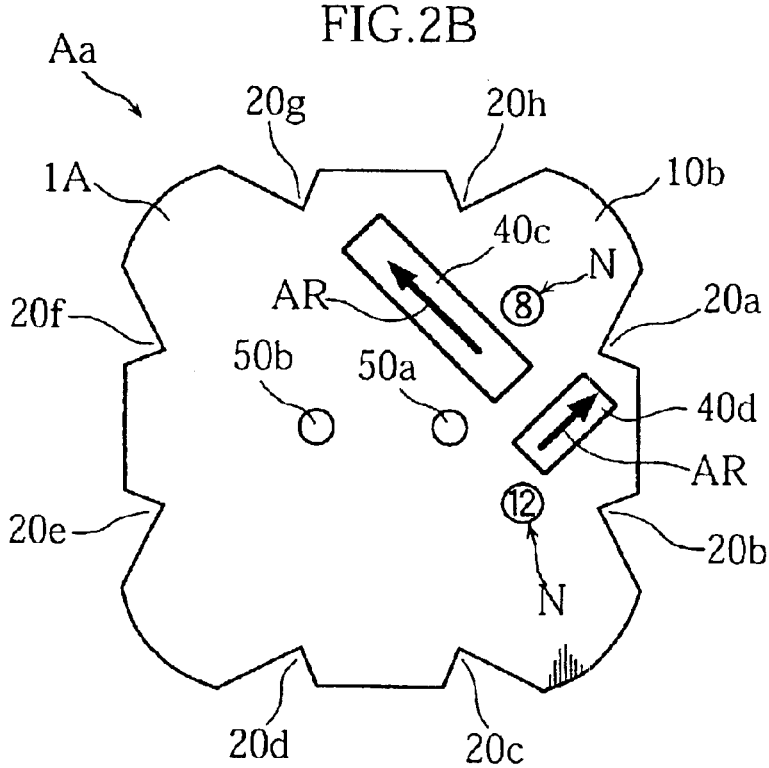
FIG. 2B is a rear view illustrating the same decorative knot maker.

FIGS. 1, 2A and 2B illustrate a decorative knot maker according to a first embodiment of the present invention.

The decorative knot maker Aa of this embodiment includes a card-like or plate-like main body 1A having a thickness of about 2–3 mm, for example. The main body 1A is formed of EVA resin, polyurethane or other elastomer and can be elastically bent in the thickness direction.

The main body 1A has an outer periphery formed with a plurality of string engagement portions 20*a*–20*h* each in the form of a recess. The string engagement portions 20*a*–20*h* are so arranged that an "igeta-musubi" (knot of parallel cross pattern) is formed when a string S is brought into engagement with the string engagement portions in the manner as will be described later. The main body 1A has an obverse surface 10*a* formed with projections 30*a* and 30*b* located generally centrally of the main body 1A, projections 30*c* and 30*d* located adjacent to the string engagement portions 20*c* and 20*e*, respectively, a groove 40*a* located between the projections 30*a* and 30*b*, and a groove 40*b* located between the projections 30*b* and 30*d*. As will be described later, the projections 30*a*–30*d* and the grooves 40*a*, 40*b* serve to provide a space between a string S and the obverse surface 10*a* of the main body 1A. The projections 30*a* and 30*b* are respectively formed with through-holes 50*a* and 50*b* penetrating through the thickness of the main body 1A. As shown in FIG. 2B, the main body 1A has a reverse surface 10*b* formed with grooves 40*c* and 40*d*.

On the obverse surface 10*a* and the reverse surface 10*b* of the main body 1A, numbers N of 1 through 14 are put for indicating the order of guiding the string S. Each of these numbers is located adjacent to the corresponding one of the string engagement portions, projections and grooves. Further, an arrow AR for indicating the direction for guiding the string S is put on the inner surface of each of the grooves 40*a*–40*d*. These numbers and arrows may be printed directly on the main body 1A, or they may be each printed on an adhesive seal, or sticker, to be attached to the main body 1A. Alternatively, the numbers and arrows may be formed integrally with the required projections or recesses in resin-molding the main body 1A.

The numbers N are circumscribed by a frame and represented in different manners depending on how the string S should be handled at the respective portions of the main body 1A. Specifically, the respective numbers N are circumscribed by a circular frame or a rectangular frame, as seen from FIG. 2A, for example. There is only a single pattern for the representation of the numbers framed by circles, i.e., those numbers are all printed black against a white background. On the other hand, there are two patterns for the representation of the numbers framed by rectangles. According to the first pattern, the numbers are printed black against a white background, while, by the second or other pattern, the numbers are printed white against a black background. The rectangular frame with a white background indicates that the string should be brought onto the opposite side of the main body 1A at the relevant portion, whereas the rectangular frame with a black background indicates that the string should pass through the through-hole at the relevant portion. The circular frames indicate that a relevant part of the string should pass under the part of the string that has been already hung on the main body 1A.

The decorative knot maker Aa can be used in the following manner.

Figure 3A:
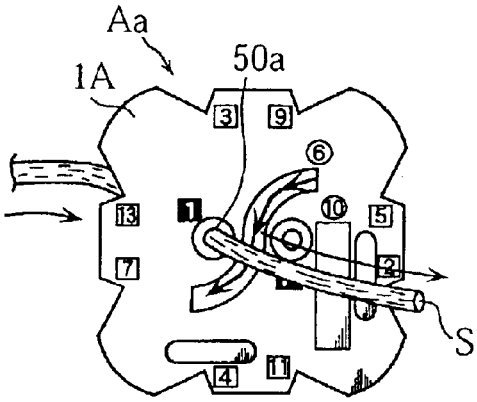
FIGS. 3A–3H illustrate the process for making a decorative knot using the knot maker of the first embodiment.

First, as shown in FIG. 3A, a string S is passed through the through-hole 50*a* from the reverse surface side to the obverse surface side of the main body 1A. Then, as shown in FIG. 3B, the string S is brought into engagement with the engagement portion 20*e* (Number 2) to be guided to the reverse surface of the main body 1A. Then the string S is brought into engagement with the engagement portion 20*h* (Number 3) to be guided to the obverse surface of the main body 1A and then into engagement with the engagement portion 20*c* (Number 4). As shown in FIG. 3C, after the string S engages the engagement portion 20*f* (Number 5), the part Sa of the string S is passed under the part Sb of the string S, as indicated by the arrow AR (Number 6). Since the part Sb bridges between the projections 30*a* and 30*d* with the groove 40*a* provided under the part Sb, there is a sufficient space for passing the part Sa of the string S without difficulty.

Figure 3D:
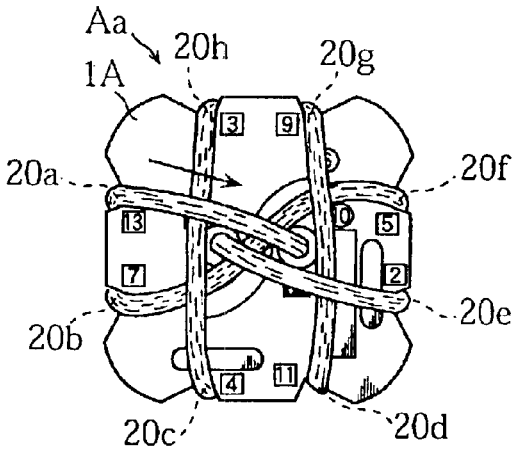
Figure 3B:
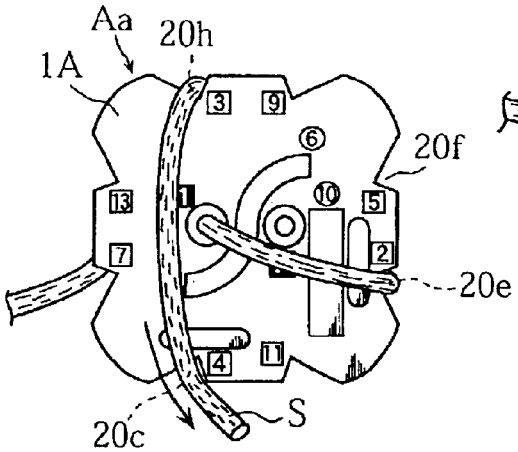

Thereafter, as shown in FIG. 3D, the string S is successively brought into engagement with remaining ones of the engagement portions 20*a*–20*h* in the order as specified by the printed numbers, to be finally passed through the through-hole 50*b* (Number 14). In these steps again, the string S can be easily passed through under itself because of the presence of the groove 40*c* (Number 8), the groove 40*b* (Number 10), and the groove 40*d* (Number 12).

Figure 3E:
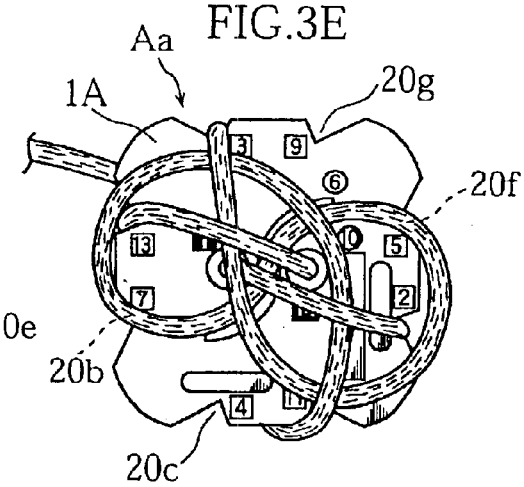
Figure 3C:
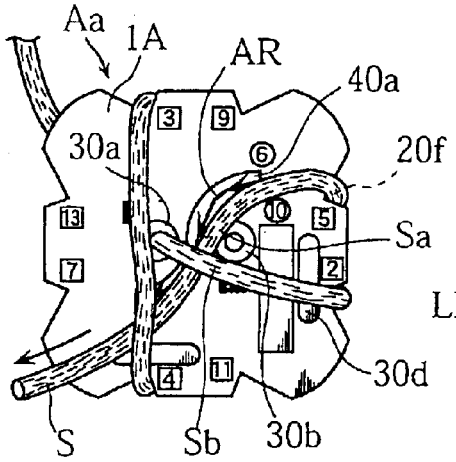
Figure 3F:
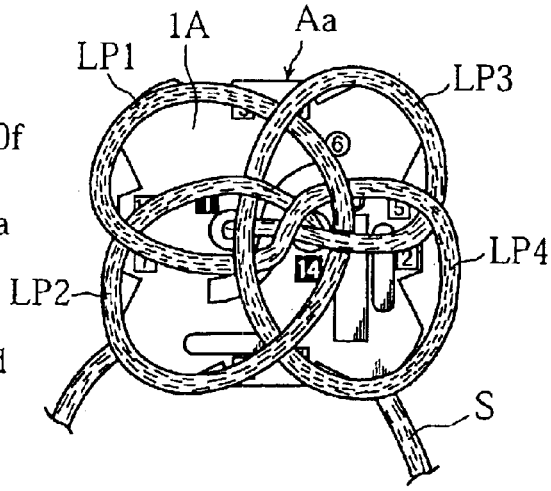

Thereafter, the part of the string S extending between the engagement portion 20*b* (Number 7) and the engagement portion 20*g* (Number 9) on the reverse side of the main body 1A is pulled toward the upper left (as viewed in FIG. 3D), to be disengaged from the main body 1A, as shown in FIG. 3E. Similarly, the part of the string S extending between the engagement portion 20*c* (Number 4) and the engagement portion 20*f* (Number 5) is disengaged from the main body 1A (FIG. 3E). Further, as shown in FIG. 3F, all the remaining engaged parts of the string S are disengaged from relevant ones of the engagement portions 20*a*–20*h*. As a result, four loops LP1–LP4 are formed. It should be noted that the main body 1A is made flexible, whereby the disengagement of the string S can be easily performed by flexing the main body 1A.

Figure 3G:
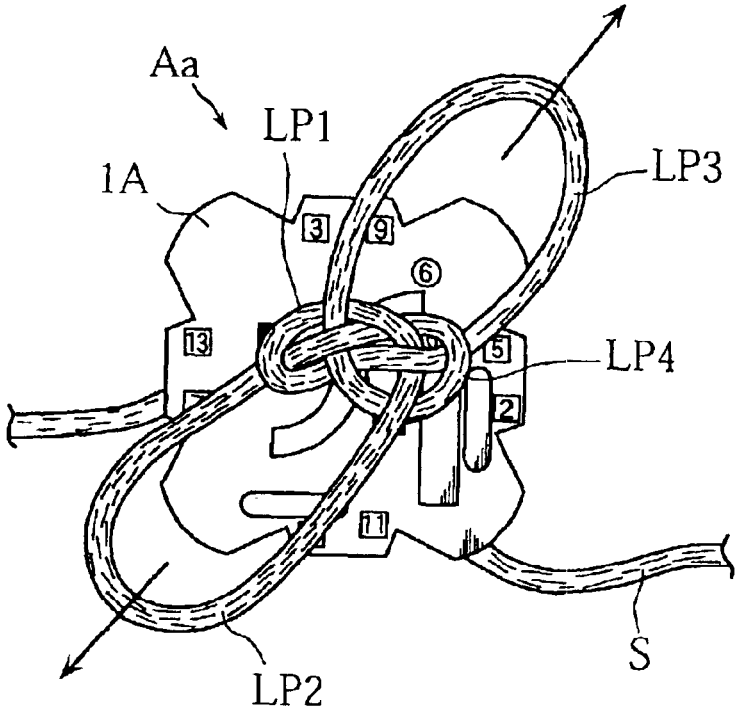
Figure 3H:
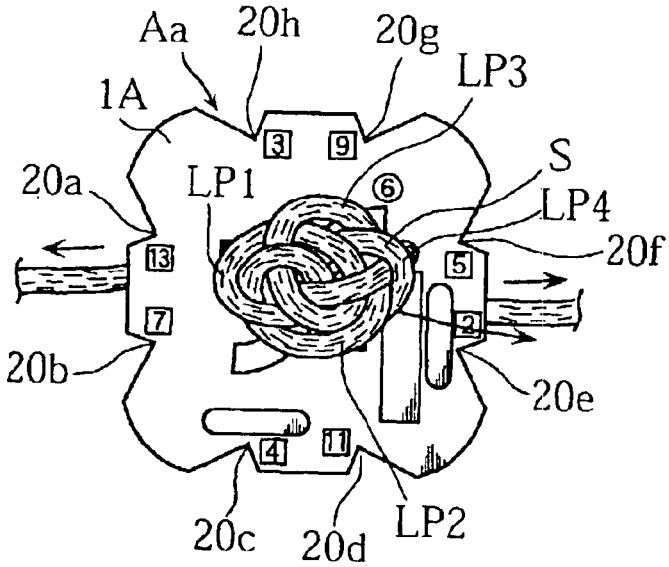

Then, as shown in FIG. 3G, two loops LP2 and LP3 are pulled outward from the main body 1A to tighten the loops LP1 and LP4. This produces an intermediate knot. After the intermediate knot is arranged lightly, the loose ends of the string S on the reverse side of the main body 1A are pulled to tighten the remaining loops LP2, LP3. Thus, as shown in FIG. 3H, the decorative knot ("igeta-musubi") is formed on the obverse side of the main body 1A.

With the use of the knot maker Aa of the present invention, the desired knot can be formed easily and properly even by unaccustomed people. In addition, it is easy to make identical decorative knots by using the knot maker Aa.

Figure 4:
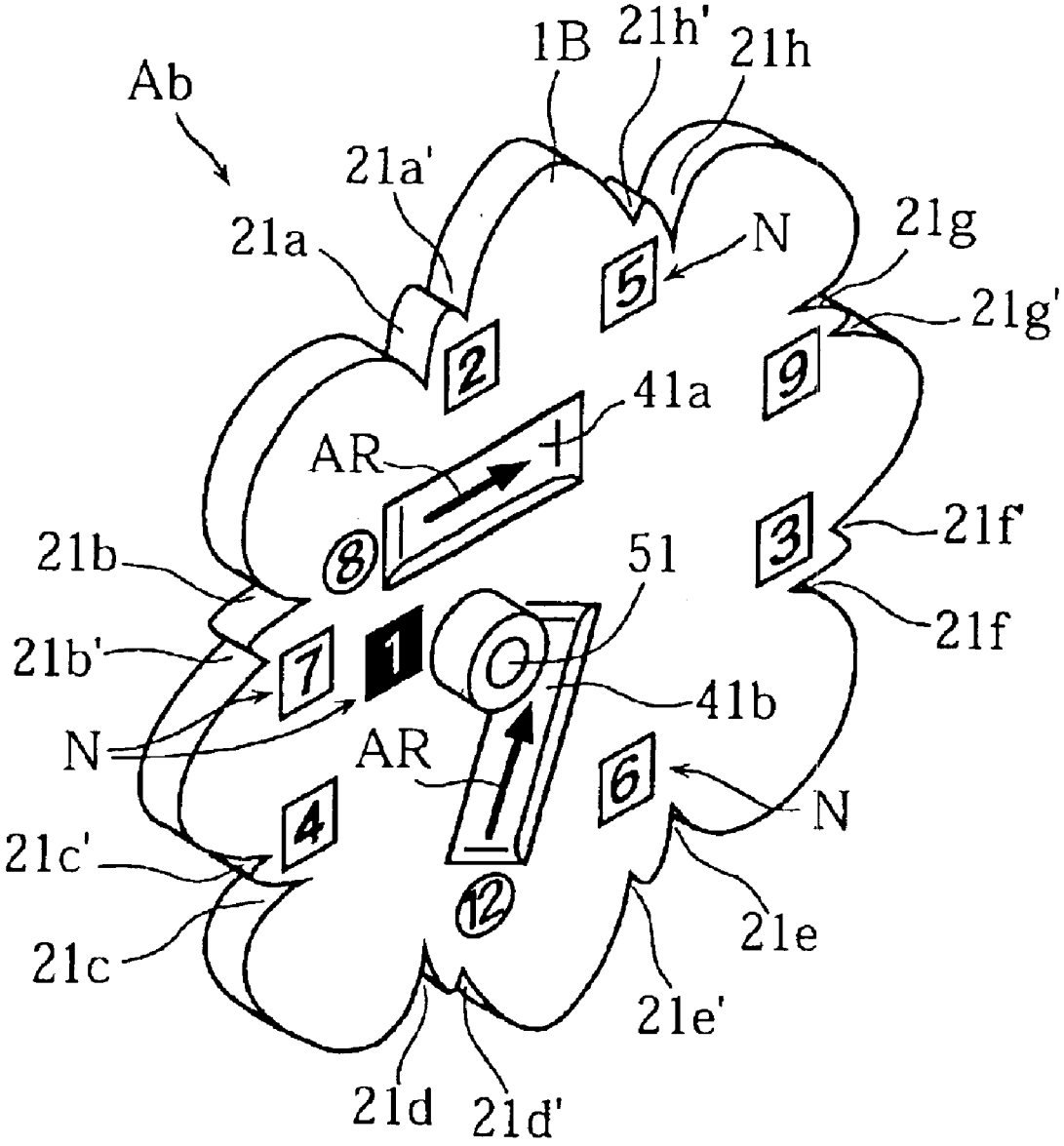
FIG. 4 is a perspective view illustrating a decorative knot maker according to a second embodiment of the present invention.
Figure 5A:
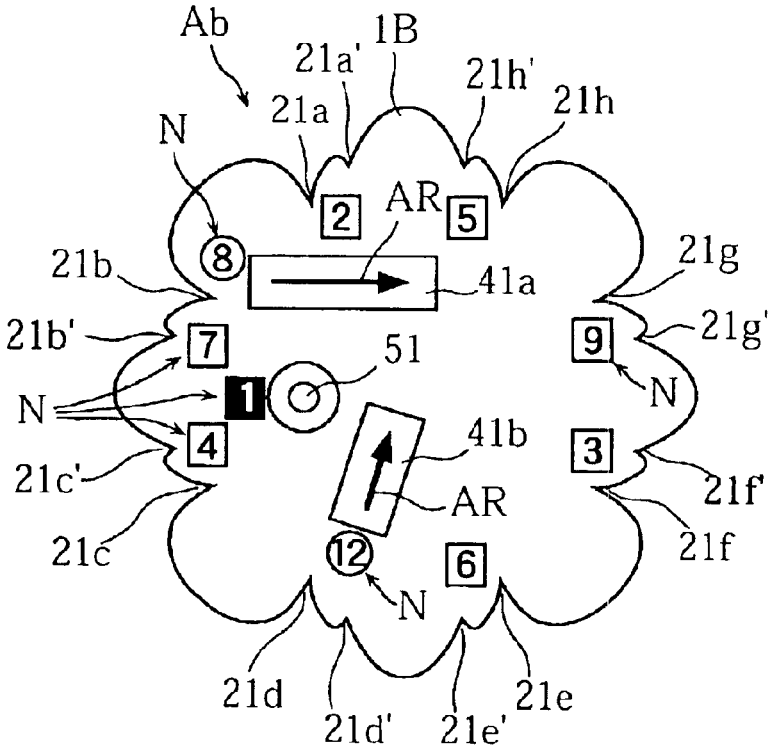
Figure 5B:
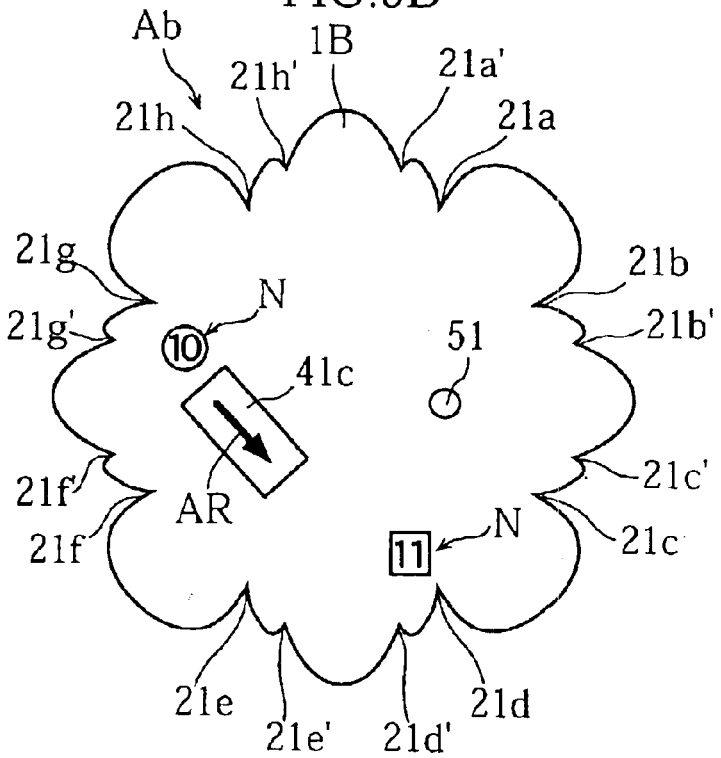
FIG. 5B is a rear view illustrating the same decorative knot maker.

FIGS. 4 and 5A–5B show a decorative knot maker Ab according to a second embodiment of the present invention.

The decorative knot maker Ab of this embodiment is for making an "awaji-musubi" (awaji-ball knot). The knot maker Ab includes a card-like main body 1B whose material and thickness are similar to those of the main body 1A of the first embodiment. The main body 1B is also elastically deformable.

The main body 1B has an outer periphery formed with a plurality of string engagement portions 21*a*–21*h* each in the form of a recess. In addition, string engagement portions 21*a*'–21*h*' are formed adjacent to the string engagement portions 21*a*–21*h*, respectively. As shown in FIGS. 5A, 5B, the main body 1B is formed with a through-hole 51 and three grooves 41*a*–41*c* on the obverse or reverse sides. Numbers N and arrows AR for indicating the order of the procedure or for showing the direction to guide the string S are printed adjacent to the through-hole 51, the grooves 41*a*–41*c* and the string engagement portions 21*a*–21*h*. Some of the numbers N are represented by white characters against black backgrounds enclosed by rectangular frames, while the others are represented by black characters against white backgrounds enclosed by rectangular frames or circular frames. The meanings of the representation are the same as those of the first embodiment.

Figure 6A:
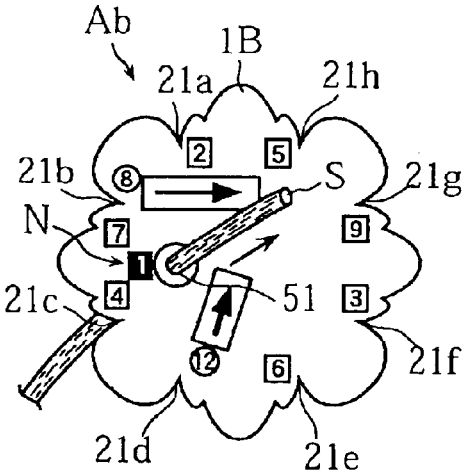
FIGS. 6A–6J illustrate the process for making a decorative knot using the knot maker of the second embodiment.
Figure 6D:
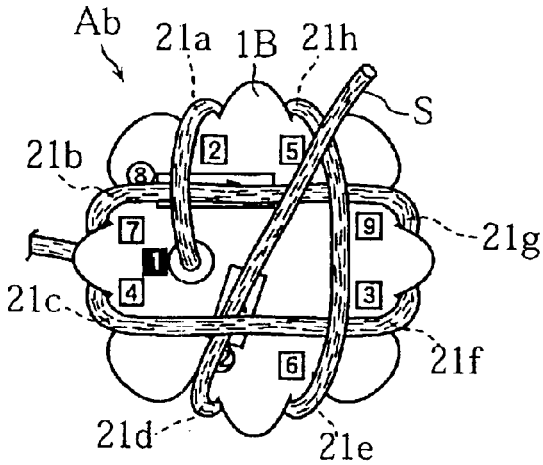
Figure 6B:
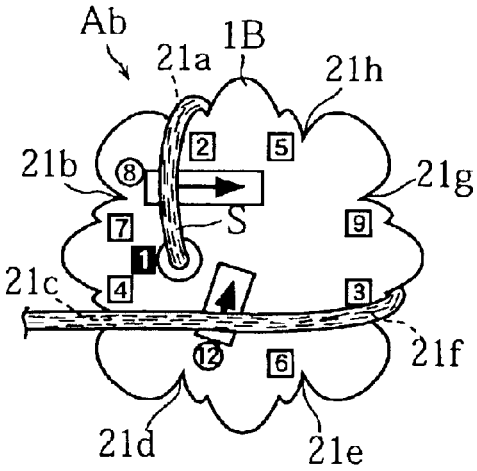
Figure 6E:
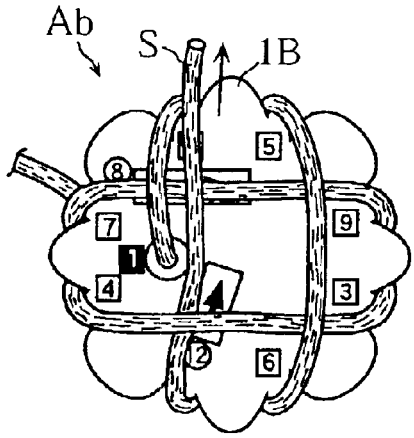
Figure 6C:
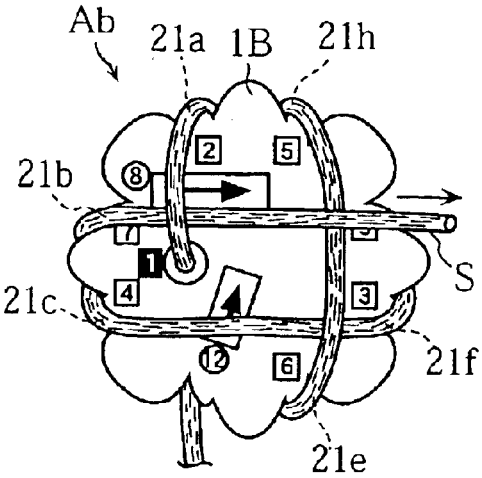
Figure 6F:
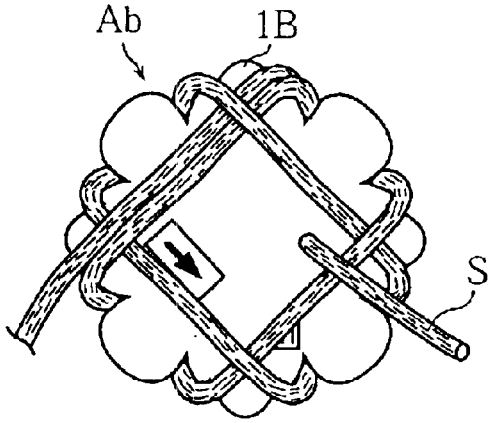
Figure 6G:
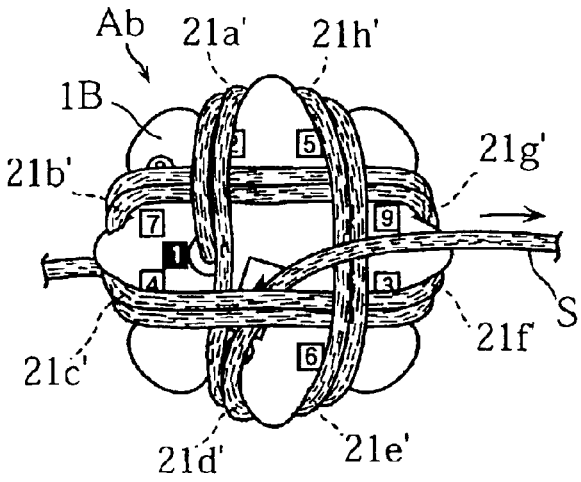

In making an "awaji-musubi" using the knot maker Ab, a string S is first caused to pass through the through-hole 51 provided with the number 1, as shown in FIG. 6A. Then, as shown in FIGS. 6B–6D, the string S is brought into engagement with all of the string engagement portions 21*a*–21*h* in the order of the numbers N. Thus, a first round of the string engagement work is completed. Then, as shown in FIGS. 6E–6G, the string S is brought into engagement with the string engagement portions 21*a*'–21*h*' in the order of the numbers N. Thus, a second round of the string engagement work is completed. Since the portions of the main body 1B with which the string S engages in the second round are positionally deviated from those in the first round, parts of the string S are neatly aligned.

Figure 6J:
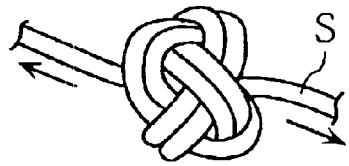
Figure 6H:
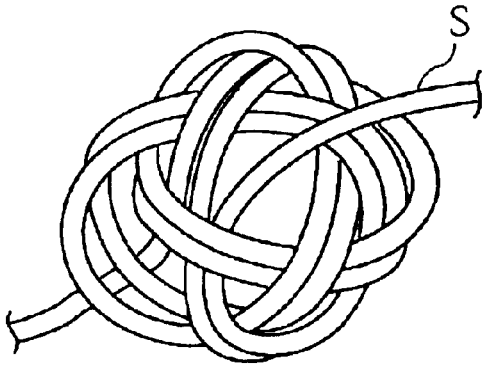
Figure 6I:
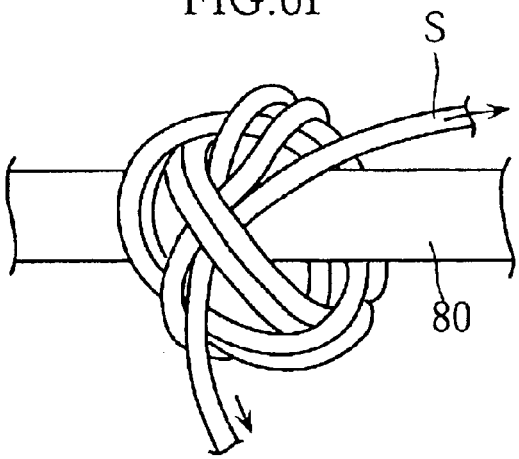

Then, as shown in FIG. 6H, the string S is disengaged from the knot maker Ab. Such disengagement of the string S can be performed easily by bending relevant portions of the main body 1B. Then, as shown in FIG. 6I, a core member 80 is inserted into the center of a plurality of loops of the string S and opposite ends of the string S are pulled to tighten the loops. Finally, as shown in FIG. 6J, the core member 80 is removed and the knot is tightened. Thus, the "awaji-musubi" is completed.

Figure 7:
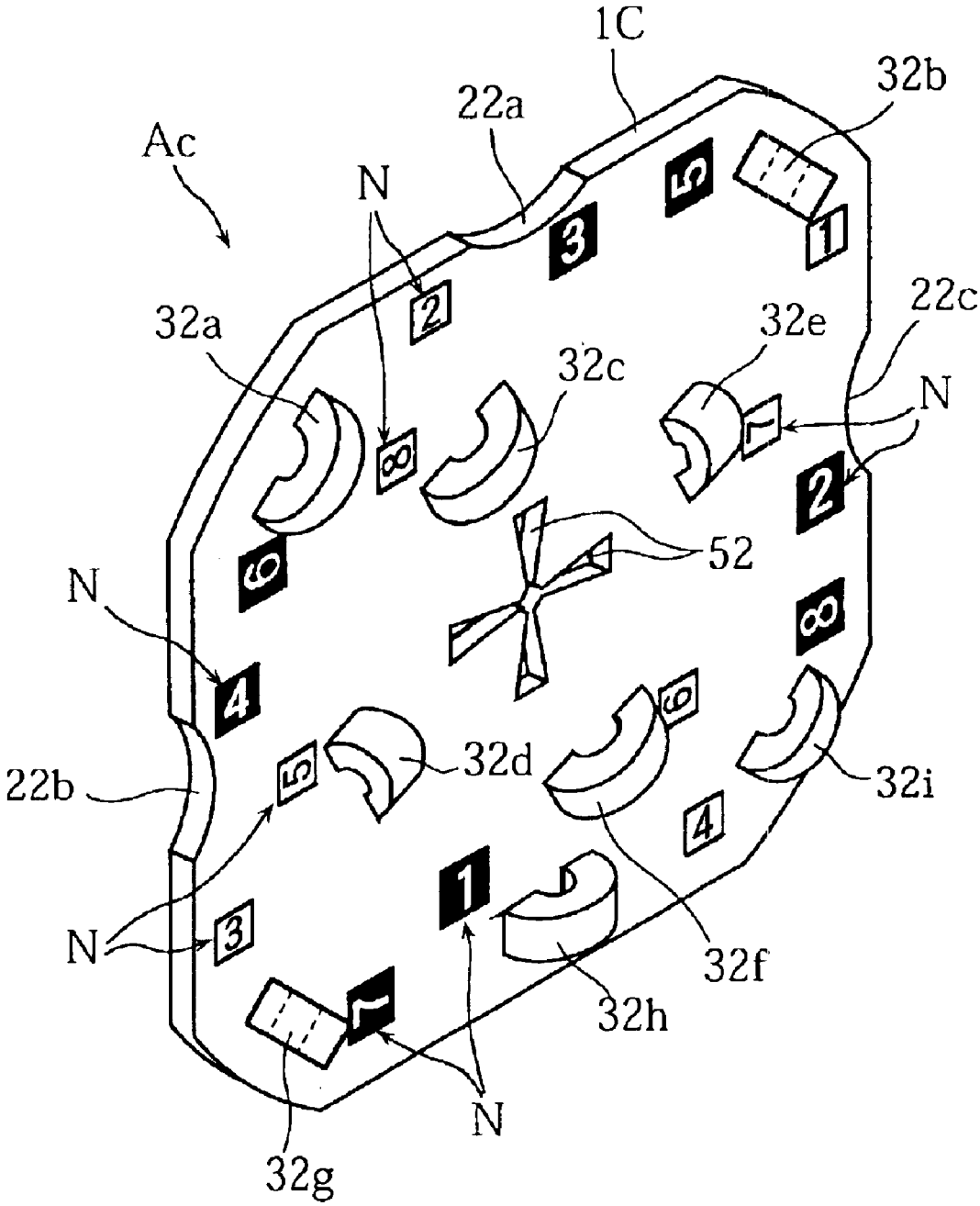
FIG. 7 is a perspective view illustrating a decorative knot maker according to a third embodiment of the present invention.
Figure 8A:
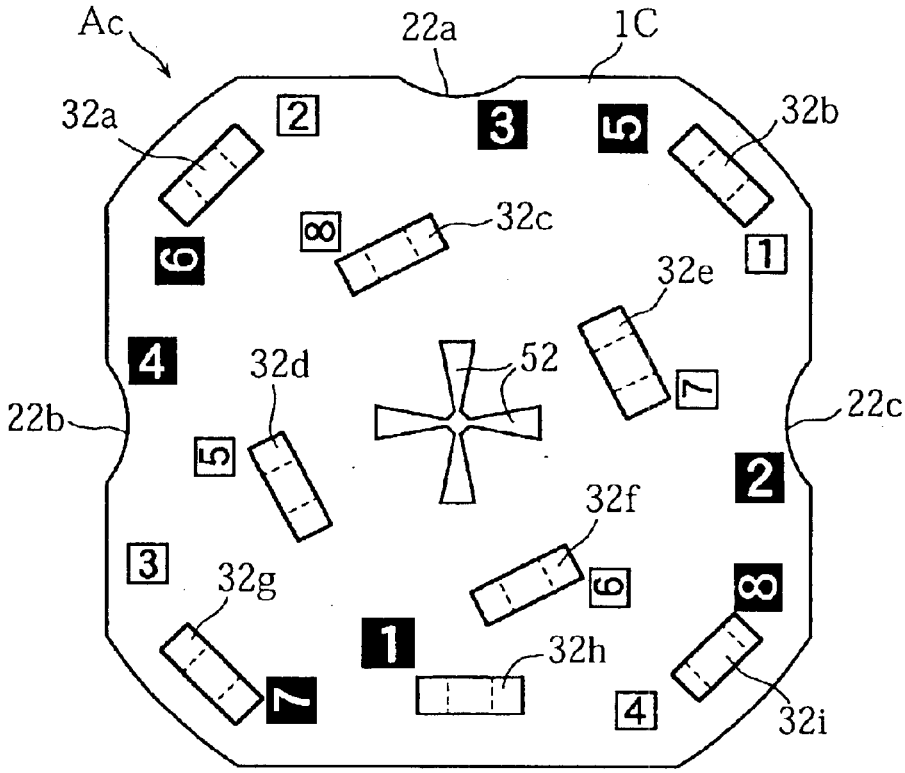
Figure 8B:
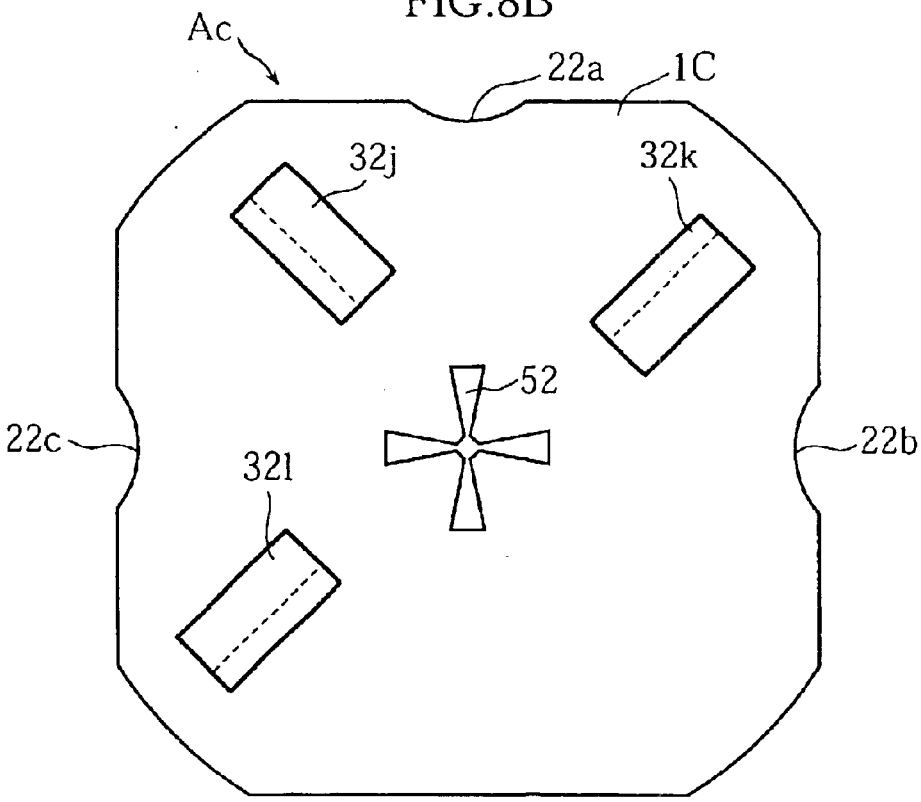
FIG. 8B is a rear view illustrating the same decorative knot maker.

FIGS. 7 and 8A–8B illustrate a decorative knot maker Ac according to a third embodiment of the present invention.

The decorative knot maker Ac of this embodiment, which is for making a "kiku-musubi" (chrysanthemum knot) includes a card-like main body 1C, as in the previous embodiments. The main body 1C is formed with recessed string engagement portions 22*a*–22*c* along its outer periphery. The main body 1C further includes a plurality of projections 32*a*–32*i* formed on its obverse surface, and a plurality of projections 32*j*–32*l* formed on its reverse surface. The main body 1C is provided with a cross-shaped through-hole 52 having four triangular openings connected to each other. As shown in FIG. 7, each of the projections 32*a*–32*i*, generally U-shaped in section, is formed with a hole for passing a string S.

On the obverse surface of the main body 1C, numbers N are printed for guiding the string S in the specified order. Each of the numbers 1–8 is represented by two different manners, i.e., a white character against a black background and a black character against a white background.

Figure 9A:
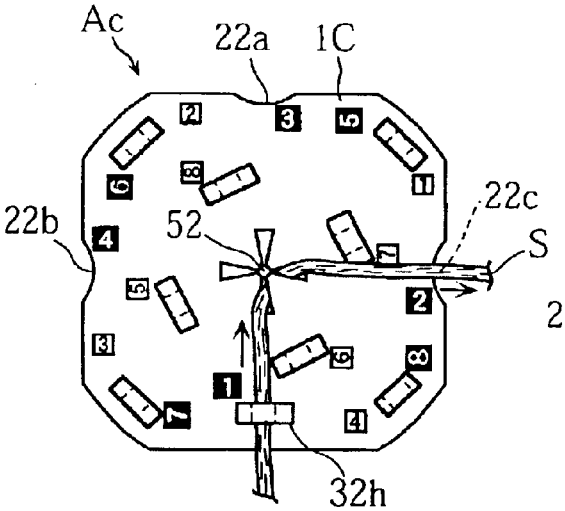
FIGS. 9A–9K illustrate the process for making a decorative knot using the knot maker of the third embodiment.
Figure 9D:
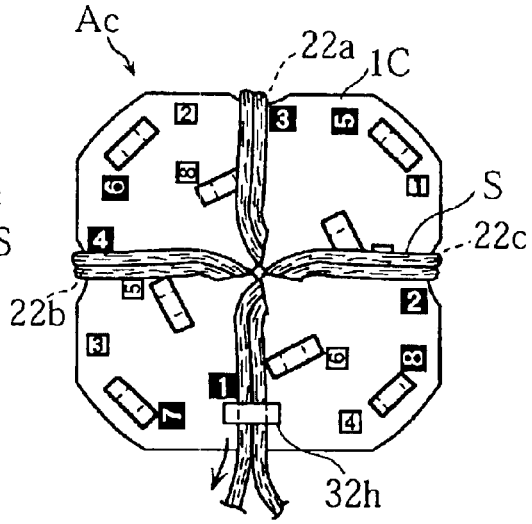
Figure 9B:
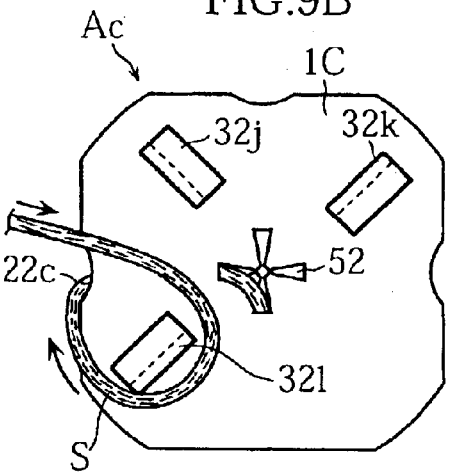

Referring to FIG. 9A, to make a chrysanthemum knot using the knot maker Ac, a string S is first passed through the hole of the projection 32*h* with the indication of number 1 in the black background. Then, the string S is guided through the through-hole 52 and guided to a portion with number 2 in the black background for engagement with the string engagement portion 22*c*. Then, as shown in FIG. 9B, the string S is hooked around the projection 321 on the reverse surface of the main body 1C and guided back to the obverse surface side. Then, as shown in FIG. 9C, the string S is again passed through the through-hole 52, to be guided to a portion with number 3 in the black background for engagement with the string engagement portion 22*a*. The string S is then hooked around the projection 32*j* on the reverse surface of the main body 1C in the same manner as shown in FIG. 9B and guided back to the obverse surface side. Thereafter, the string is bought into engagement with the string engagement portion 22*b* and guided to the reverse surface side for engagement with the projection 32*k*. The string S, after hooked around the projection 32*k*, is guided to the obverse surface side, passed through the through-hole 52 and again passed through the hole of the projection 32*h*, as shown in FIG. 9D.

Figure 9E:
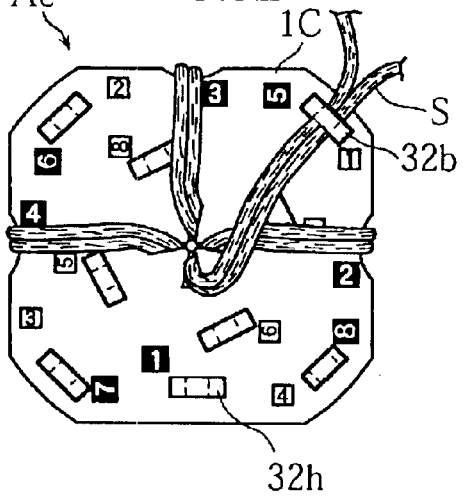
Figure 9C:
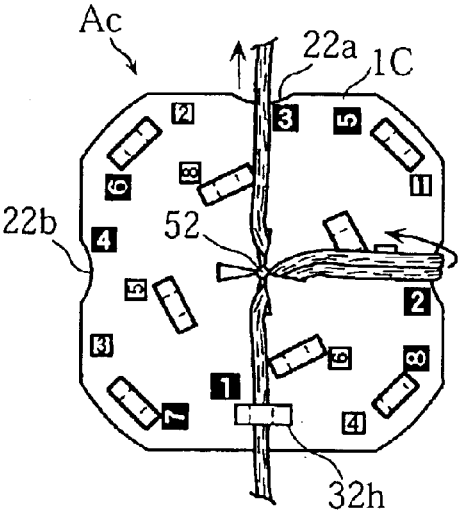

Then, as shown in FIG. 9E, the part of the string S passing through the projection 32*h* is disengaged and inserted into the hole of the projection 32*b* with number 1 in the white background.

Figure 9F:
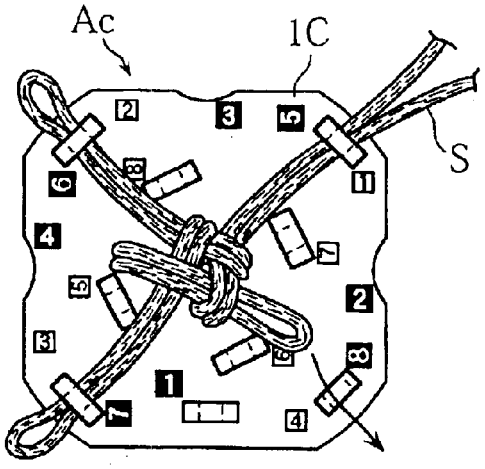

Thereafter, the part of the string S hooked around the projection 321 on the reverse side is disengaged and folded back onto the obverse side of the main body 1C to be inserted into the hole of the projection marked by number 2 in the white background. Then, the part of the string S hooked around the projection 32*j* on the reverse side is disengaged and folded back onto the obverse side of the main body 1C to be inserted into the hole of the projection marked by number 3 in the white background. Likewise, the part of the string S hooked around the projection 32*k* on the reverse side is disengaged and folded back onto the obverse side of the main body 1C to be inserted into the hole of the projection marked by number 4 in the white background, as shown in FIG. 9F.

Figure 9G:
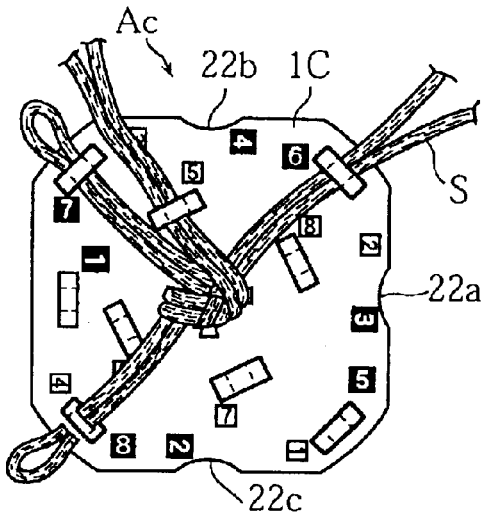

Then, as shown in FIG. 9G, the part of the string S inserted into the hole of the projection marked by number 5 in the black background is disengaged and inserted into the hole of the corresponding projection marked by number 5 in the white background. In the same manner, the respective parts of the string S held by the projections marked by number 6, 7 and 8 in the black background are disengaged in this order, and inserted, as shown in FIG. 9H, into the holes of the corresponding projections marked by number 6, 7 and 8 in the white background. The result is shown in FIG. 9I.

Figure 9J:
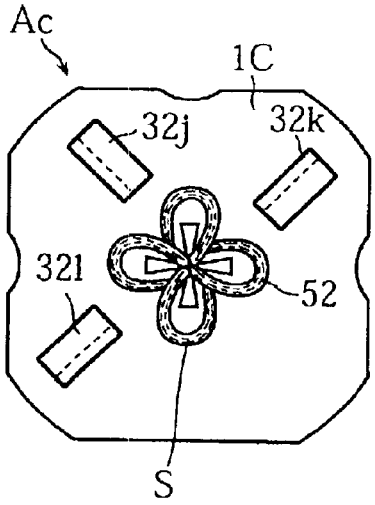
Figure 9H:
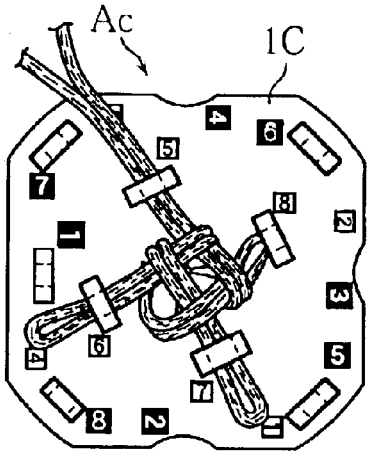
Figure 9K:
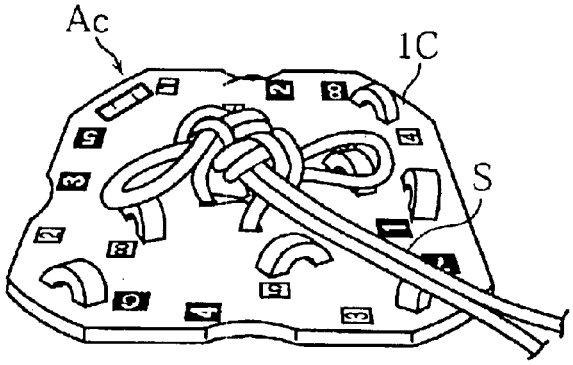
Figure 9I:
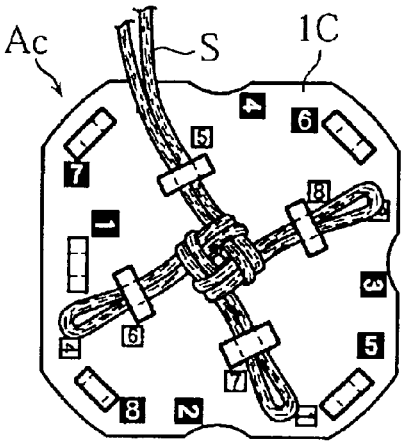

Then, referring to FIG. 9J, the main body 1C is turned over to pull the parts of the string S exposed from the through-hole 52, so that the knot on the obverse side of the main body 1C is put into desired shape. In the state shown in FIG. 9K, the completed chrysanthemum knot is pulled upward for removal from the main body 1C.

Figure 10A:
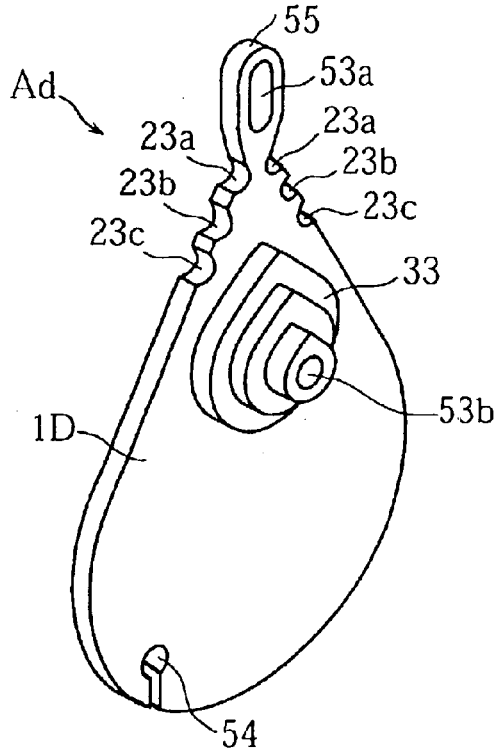
FIG. 10A is a perspective view illustrating a decorative knot maker according to a fourth embodiment of the present invention.
Figure 10B:
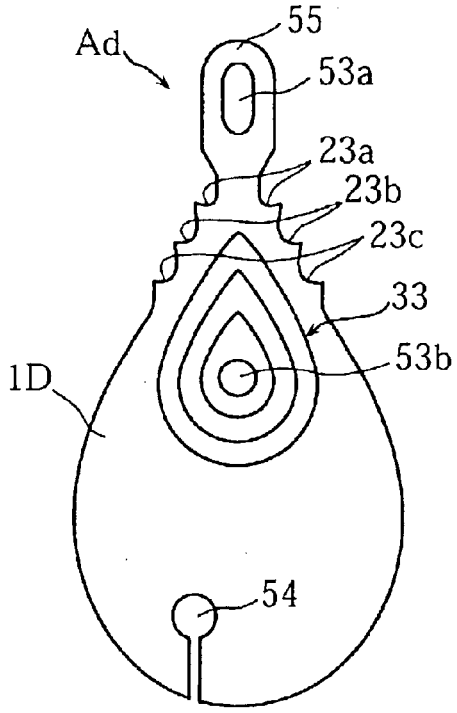
Figure 10C:
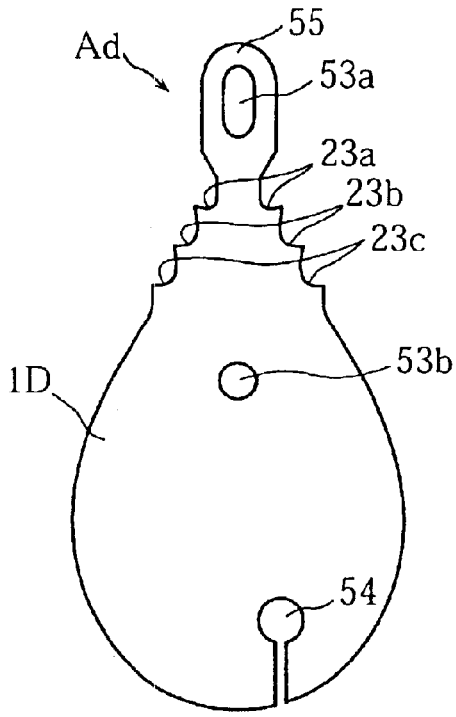
FIG. 10C is a rear view illustrating the same decorative knot maker.

FIGS. 10A–10C illustrate a decorative knot maker Ad according to a fourth embodiment of the present invention.

The decorative knot maker Ad of this embodiment, which is for making a "biwa-musubi" (Japanese lute knot) includes a card-like main body ID. The main body ID includes a projection 55 formed with a through-hole 53*a*, and is formed with three pairs of string engagement portions 23*a*–23*c* adjacent to the projection 55, as shown in FIG. 10A. The main body ID is provided, on its obverse surface, with a stepped projection 33. The projection 33 is formed, at its generally central portion, with a through-hole 53*b* penetrating the main body 1D. The main body 1D is further formed with a cutout 54 at a portion away from and below the through-hole 53*b*, as seen from FIG. 10B, for example. Unlike the first through the third embodiments, the knot maker Ad is not provided with numbers for specifying the string-guiding order, since the "biwa-musubi" is relatively easy as compared with the knots of the foregoing embodiments, and the process is readily understandable without the help of such numbers.

Figure 11A:
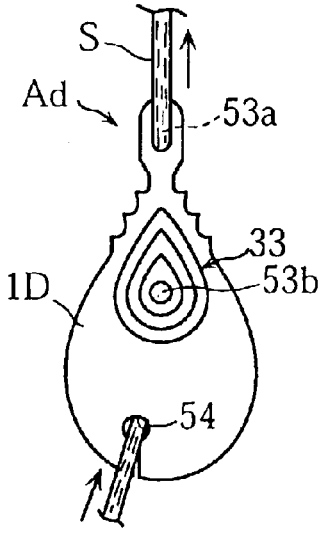
FIGS. 11A–11I illustrate the process for making a decorative knot using the knot maker of the fourth embodiment.
Figure 11D:
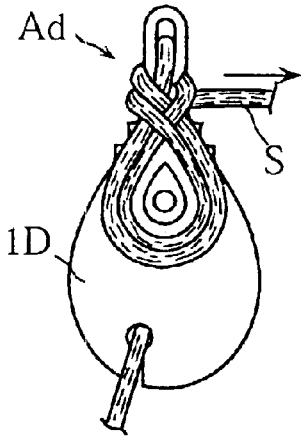
Figure 11B:
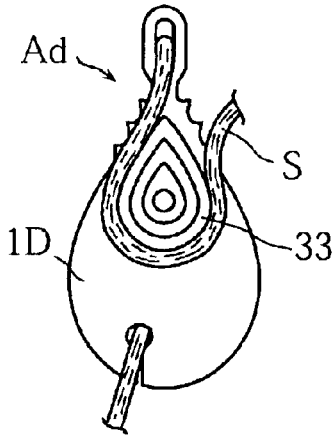
Figure 11E:
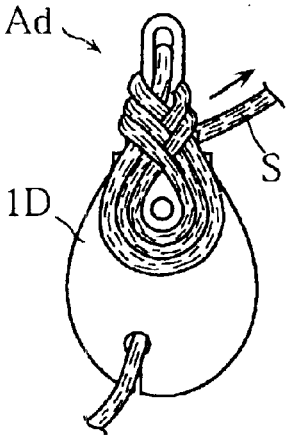
Figure 11C:
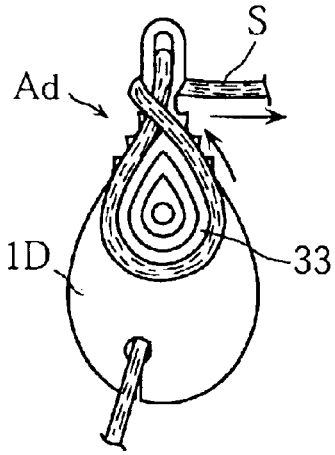
Figure 11F:
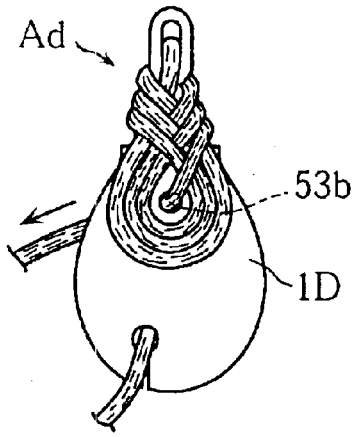
Figure 11G:
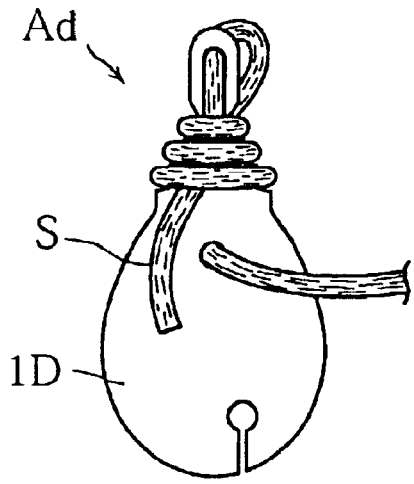
Figure 11H:
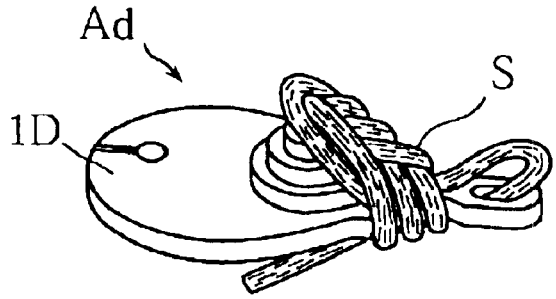
Figure 11I:
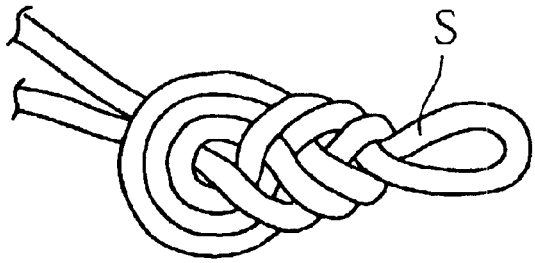
Figure 12:
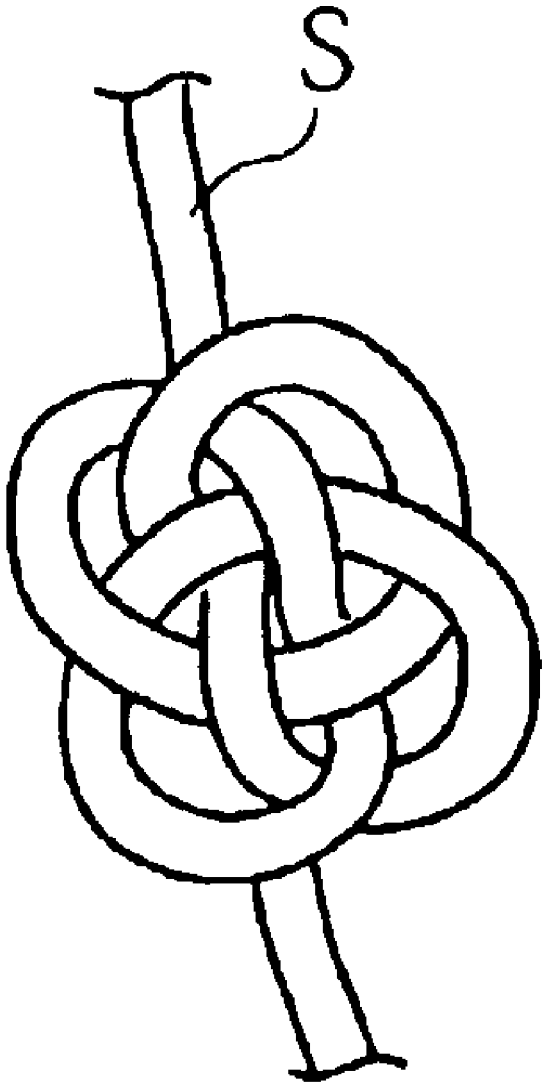
FIG.12 PRIOR ART
FIG. 12 shows an "igeta-musubi" formed by the conventional method.

To form the decorative knot using the knot maker Ad, as shown in FIG. 11A, a string S is first guided into the cutout 54 and then into the through-hole 53*a*. Then, as shown in FIGS. 11B–11E, the string S is successively wound around the stepped portions of the projection 33 and the string engagement portions 23*a*–23*c* to repetitively form an 8-like shape. Then, as shown in FIGS. 11F and 11G, a leading part of the string S is passed through the through-hole 53*b* and pulled to tighten the parts in the 8-like shape. Then, as shown in FIGS. 11H and 11I, the string S as a whole is removed from the knot maker Ad.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A tool for making a decorative knot, the tool comprising:

a generally flat main body having an obverse surface and a reverse surface opposite to the obverse surface, the obverse surface and the reverse surface having identically configured peripheral contour lines;

a plurality of string engagement portions provided on the main body;

wherein the string engagement portions are constructed to come into engagement with a string in a prescribed order;

the string engagement portions comprise at least one cutout formed on the main body to partially define the peripheral contour lines of the obverse and reverse surfaces; and the at least one cutout is constructed such that the peripheral contour lines of the obverse and reverse surface are adapted to contact a string in which a decorative knot is being formed.

2. The tool according to claim 1, further comprising indications arranged correspondingly to the string engagement portions for showing an engaging order of the string.

3. The tool according to claim 2, wherein said indications comprise a plurality of patterns by which representing manners of figures are different from each other.

4. The tool according to claim 1, wherein the main body is flexible.

5. The tool according to claim 1, wherein the main body is formed with at least one through-hole for passing the string.

6. The tool according to claim 1, further comprising a hook provided on the main body for engaging with a loop of the string.

7. The tool according to claim 1, wherein the main body is formed with at least one groove for facilitating passage of the string.

8. The tool according to claim 7, wherein the main body is formed with at least two projections flanking the groove.

* * * * *